US010245203B1

(12) United States Patent
Norris

(10) Patent No.: US 10,245,203 B1
(45) Date of Patent: Apr. 2, 2019

(54) HOLDER FOR STORING PET REMAINS

(71) Applicant: Pet Declaration, Inc., Tampa, FL (US)

(72) Inventor: Gena Marie Norris, Tampa, FL (US)

( * ) Notice: Subject to any disclaimer, the term of this patent is extended or adjusted under 35 U.S.C. 154(b) by 0 days.

(21) Appl. No.: 16/130,492

(22) Filed: Sep. 13, 2018

(51) Int. Cl.
*A61G 17/08* (2006.01)
*A61G 17/02* (2006.01)

(52) U.S. Cl.
CPC ..... *A61G 17/08* (2013.01); *A61G 17/02* (2013.01)

(58) Field of Classification Search
CPC ..... A61G 17/08; A61G 17/02; B65D 1/0246; B65D 53/02; B65D 2251/20; B65D 2251/06
USPC ..... 27/1, 17; 215/43, 45; 220/378, 806
See application file for complete search history.

(56) References Cited

U.S. PATENT DOCUMENTS

| | | | | |
|---|---|---|---|---|
| 232,782 | A | 9/1880 | Townsend | |
| 5,016,330 | A | 5/1991 | Botsch | |
| 5,896,632 | A | 4/1999 | Sturino | |
| D418,271 | S | 12/1999 | Parker | |
| 6,023,822 | A | 2/2000 | Luebke | |
| 6,775,886 | B2 | 8/2004 | Ogle, III | |
| 6,785,938 | B1 | 9/2004 | Johansen, Jr. | |
| 7,627,935 | B1 * | 12/2009 | Ostrum | A61G 17/08 27/1 |
| 2002/0100152 | A1 | 8/2002 | Ortega | |
| 2009/0025194 | A1 * | 1/2009 | Pearce | A61G 17/08 27/1 |

* cited by examiner

*Primary Examiner* — William L Miller
(74) *Attorney, Agent, or Firm* — Thomas H. Stanton, Esq.; Stanton IP Law Firm, P.A.

(57) ABSTRACT

A holder for storing cremation ashes. The holder comprises a body section, a cavity contained in the body section for holding cremated remains of an animal, a removable head section, a means for attaching a head section to the body section, a locking means to lock head section to body section. The head section being a representative head of a deceased pet which is attached to the body section.

16 Claims, 12 Drawing Sheets

HOLDER FOR STORING PET REMAINS

STATEMENT REGARDING FEDERALLY SPONSORED RESEARCH OR DEVELOPMENT

The research for the Patent "Holder for storing pet remains" was not funded by federally sponsored research or development.

DESCRIPTION

Field of Disclosure

The invention relates to a holder or container for storing pet remains. The holder comprises a body section, a means contained in the body section for holding cremated remains of an animal, a removable head section, a means for attaching a head section to the body section, a locking means to lock head section to body section. The head section being a representative head which is attached to the body section.

Background of the Invention

The invention relates to a container for housing the remains of an animal. The following prior art is known and relates to pet containers for housing the remains of animals, U.S. Pat. No. 6,023,822 to Luebke, U.S. Patent Application Publication No. 2002/0100152 to Ortega, U.S. Pat. No. 6,775,886 to Ogle, II, U.S. Pat. No. 5,896,632 to Sturino, U.S. Pat. No. 5,016,330 to Botsch, U.S. Pat. No. 232,782 to Townsend, U.S. Pat. No. D 418,271 to Parker, U.S. Pat. No. 6,785,938 to Johansen, Jr., and U.S. Pat. No. 6,023,822 to Luebke the disclosures of these references are hereby incorporated herein by reference in their entirety.

The prior art does not disclose a means for housing the cremated remains of a pet having a body section that is capable of receiving a different head section and the head section having a locking means to lock the head section to the body section. The locking of the head section to the body prevents the removal of the head section from the body section. By allowing for interchangeability of the head the instant invention allows the owner the ability to simply change the head portion of the holder or container and utilize a standard body for storing pet remains so that the external appearance of the holder or container is modified by the replacement of one head section with another head section. This interchangeability is beneficial to the manufacturer and the pet owner. The manufacturer gains economy of scale with their manufacturing process for the body portions which reduces their cost of production and permits a simple method of achieving mass production. The owner gets the benefit of being able to select the head portion that is the best match for their beloved pet.

As seen in the prior art many inventions have been disclosed to store the remains of an animal. Many of them have either decorative or functional uses and some may combine the two. However, there is a need for a housing for animal remains that is capable of securely holding the remains of one or more animals and is capable of preventing removal or accidental spillage of the animal remains. Additionally, there is a need for a housing for storage of animal remains that provides a closer likeness to the deceased pet by allowing the head portion of the holder or container to be customized by substituting one of a number of standard configurations of the pet's head to the housing/holder or container so that the combination of head and housing more closely represents the deceased pet. The owner may also customize the head based on the exact likeness of the pet being interred.

Therefore, there is a need for a housing for animal remains that is lockable and is capable of securely holding the remains to prevent removal or accidentally escaping from the housing if the housing is tipped over.

Therefore, there is a need for a housing/holder for animal remains that provides a closer likeness to the deceased pet.

Additionally, there is a need for interchangeability of the head portion for a housing for pet remains that reduces manufacturing cost of the largest section of the housing which is the body by making it universal for each type of pet and allows the customization by promoting interchangeability of the head section.

SUMMARY OF THE INVENTION

It is therefore a primary objective of the invention to provide a means of housing animal remains that is both cost affective, secure and attractive. The housing for the holder or container of the instant invention is comprised of five sections. First there is a body section of the invention which when the invention is configured for a pet that is a dog would be an American Kennel Club (AKC) breed standard body form from the American Kennel Club Official approved breed standards and is a life size representation of the animal. http://www.akc.org/sports/conformation/judging-information/judges-study-guides/. The body section forms the container for the animal remains and can hold one or more cremated remains within the body.

The second part is the head section of the invention which when the invention is configured for a dog would be an (AKC) breed standard and is a life size representation of the animal. However, breeds can have more than one head type such as the chihuahua which can have a deer head shape or apple head shape. The ability to have multiple interchangeable heads allows the owner to select the head and facial features that most remind them of the pet.

The third feature is the locking mechanism of the invention used to attach the head section to the body section.

The fourth feature is a locking pin used to lock the head section to the body section.

The fifth is a hollow cavity section configured to allow the storage of at least one cremated pet remains.

Another object of the invention is to allow a pet owner to inter multiple pet remains in the same housing.

Another objective of the invention is to create a means of housing animal remains that is both secure and attractive.

Another objective of the invention is to create a means of housing animal remains that is lockable.

Another objective of the invention is to create a means of housing animal remains that is representative of a specific animal.

Another objective of the invention is to create a lower cost housing system for animal remains.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF PREFERRED EMBODIMENTS

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

The terms breed, pet, and animal are used interchangeably to refer to pets.

The terms holder, housing, container, and cavity are used interchangeably to refer to a container for the remains of a pet.

The term pets can alternatively be dogs, cats, fish, birds, reptiles, rabbits or any such animal which an owner wishes to remember.

The term owner, person, or individual is used interchangeably to refer to an individual who is using the invention In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "feature", "section", "element", or "component" encompass both sections, elements and components comprising one unit and sections, elements and components that comprise more than one unit, unless specifically stated otherwise.

The terms "feature", "section", "element", or "component" are used interchangeably.

Figure 1:
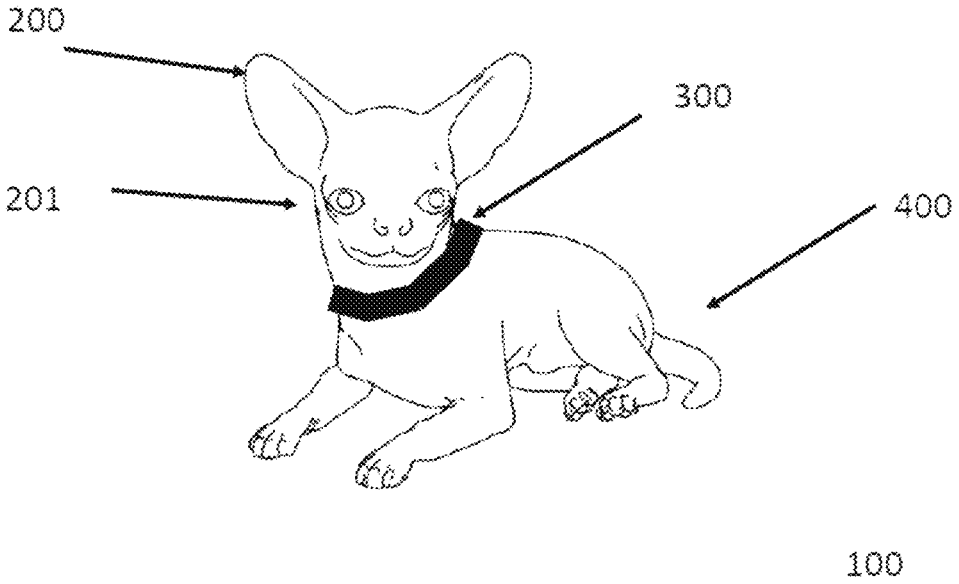
FIG. 1 is a perspective view of a first embodiment of the invention.
Figure 2:
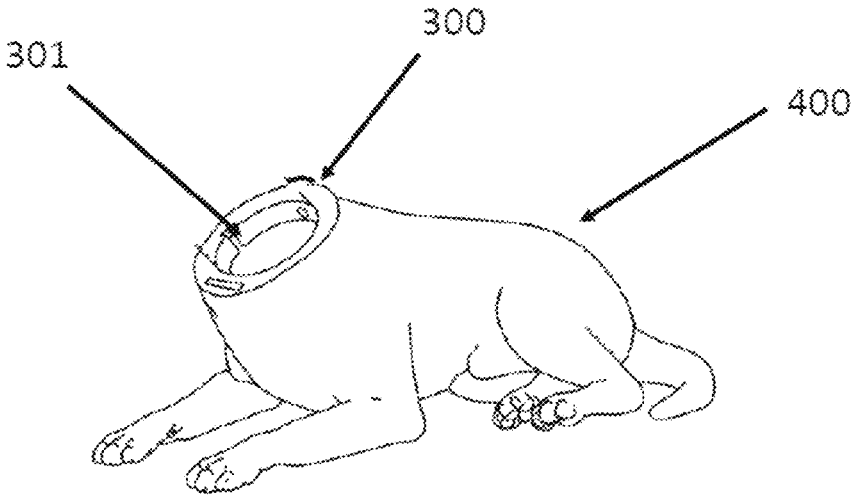
FIG. 2 is perspective view of body section of the invention.
Figure 3:
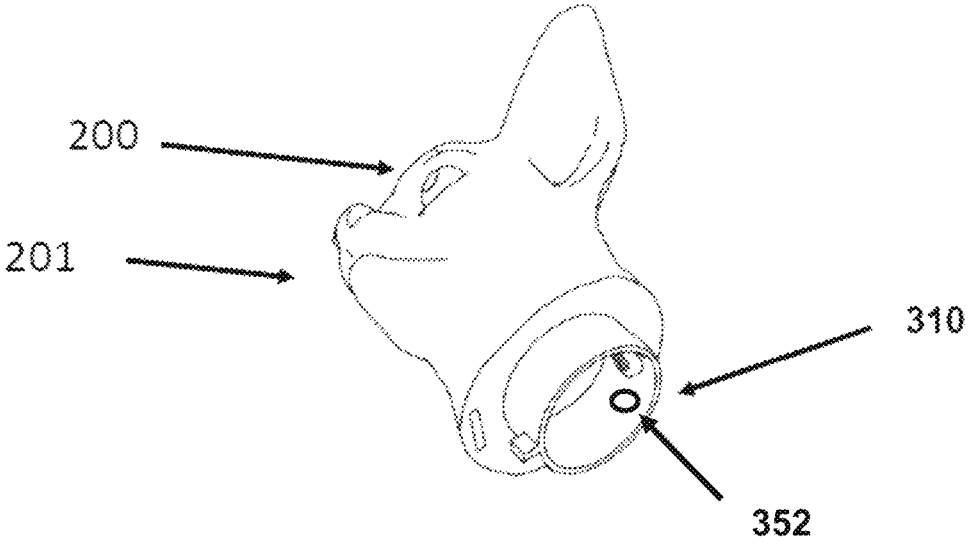
FIG. 3 is a bottom-oriented perspective view the head section of the invention.
Figure 4:
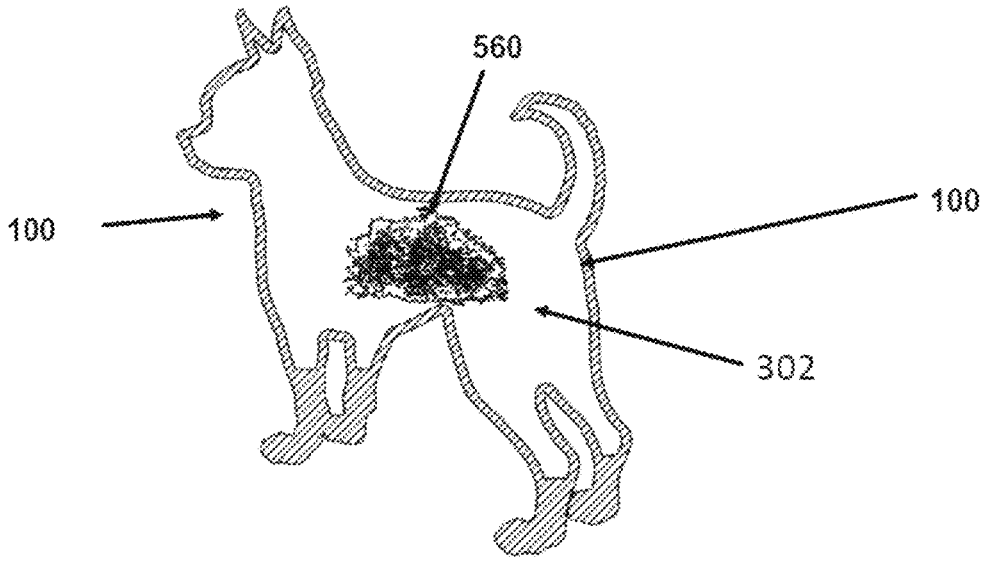
FIG. 4 is a cross section of the body section of the invention showing the remains in the hollow body cavity of the invention.
Figure 5:
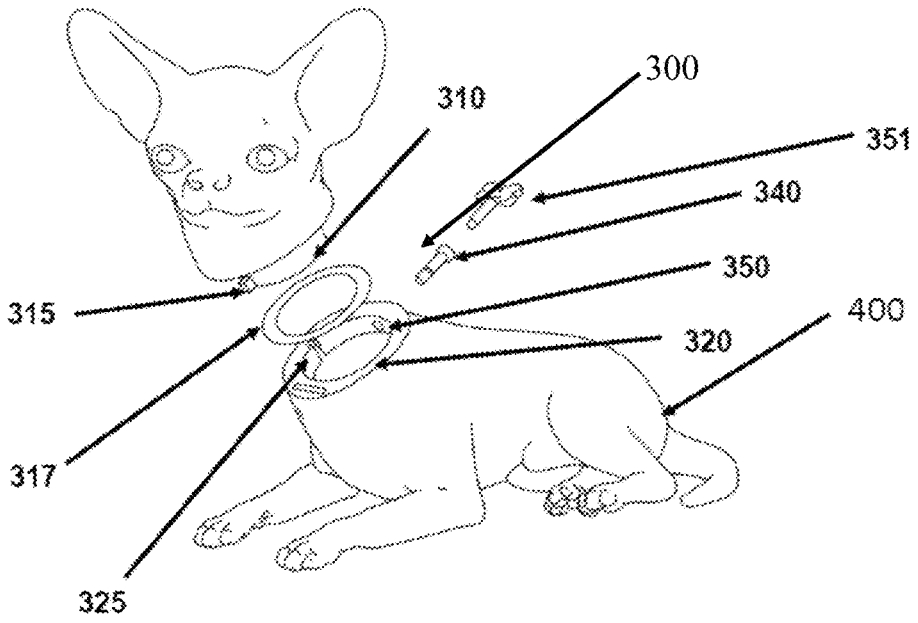
FIG. 5 is an exploded perspective view of the invention showing the locking ring assembly and pin.
Figure 6:
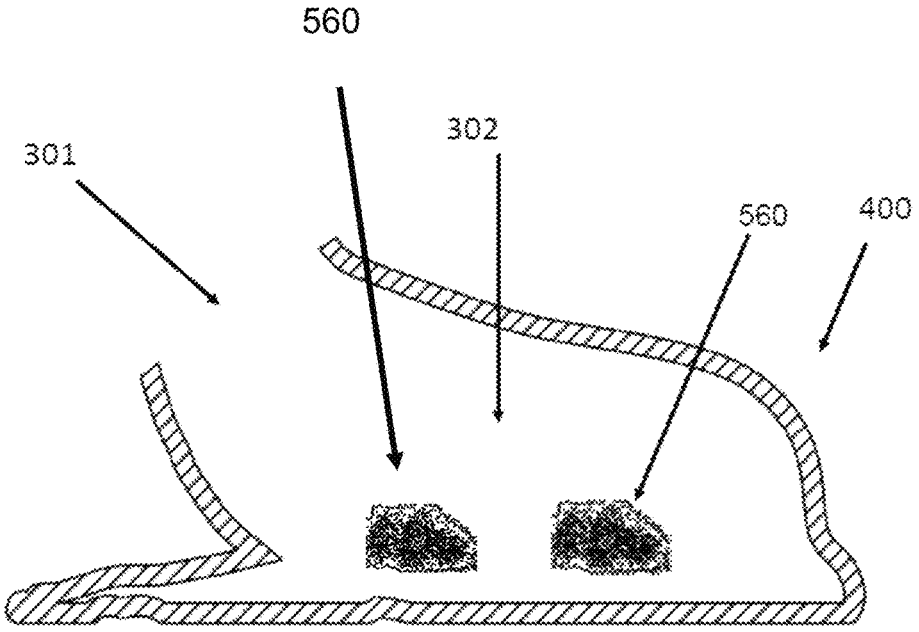
FIG. 6 is a cross sectional drawing of the lower portion of the invention holding stored remains.
Figure 7:
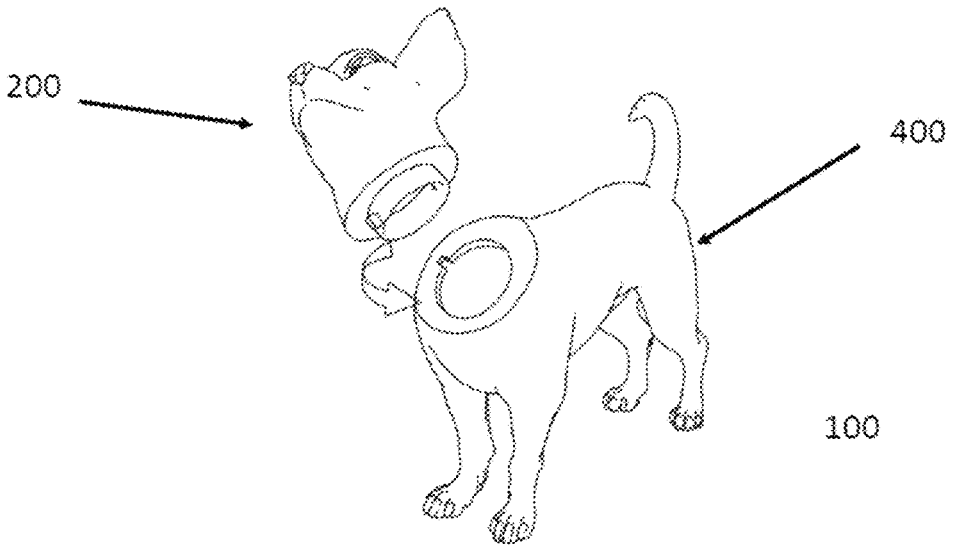
FIG. 7 is exploded perspective view of the invention showing how the head portion of the invention is attached to the body portion of the invention.

As shown in FIG. 1 the invention is a housing 100 for cremated animal remains 560 which when normally viewed is displayed with three visible sections comprising of a head section 200 having facial features 201, locking ring section 300, and body section 400. A unique aspect of the invention is that it allows the utilization of multiple interchangeable heads that allows the owner to select the head and facial features that most remind them of the pet. Additionally, the manufacturer gains economy of scale with their manufacturing process for the body portions which reduces their cost of production and permits a simple method of achieving mass production. The owner gets the benefit of being able to select the head portion that is the best match for their beloved pet.

A detailed inspection of the housing 100 shows that it consists of five sections for housing the cremated remains of an animal as shown in FIGS. 1-11. First there is a body section 400 of the invention which when the invention is configured for a pet that is a dog would be an American Kennel Club (AKC) breed standard body form from the American Kennel Club Official approved breed standards and is a life size representation of the animal. http://www.akc.org/sports/conformation/judging-information/judges-study-guides/.

The body section 400 can be constructed from materials consisting of wood, plastic, rubber, resin, glass, metal, stone, concrete, and ceramics. The materials selected for the body section 400 should also be non-porous to adequately contain the cremated animal remains 560 within the body section 400. To ensure that the body section 400 is non-porous an optional polymer coating can be applied to the interior of the hollow cavity 302.

The second part is a head section 200 having facial features 201 of the invention which when the invention is configured for a dog is also an (AKC) breed standard and is a life size representation of the animal. However, animal breeds can have more than one head type such as the chihuahua which can have a deer head shape or apple head shape. The head section 200 is removable which allows the owner to select a head section 200 having facial features 201 that most remind them of the specific pet. Specifically, for a pet that is a dog the AKC describes that the various breeds can have more than one head type. The housing 100 of the invention is specifically designed to hold cremated animal remains 560 and the body section 400 is designed to provide a means to support a head section 200 that represents the animal being interred in the housing 100. This feature of the instant invention allows the owner the ability to customize the invention to create a housing for the animal remains that reminds them of the pet. Additionally, by separating and creating two separate components that form the housing 100 it allows the manufacture to manufacture body sections 400 to meet overall demand and then manufacture head sections 200 having facial features 201 to meet specific customer demands. This functionality allows the manufacturer to achieve greater economies of scale by manufacturing the body sections 400 which in most cases is the larger component of housing 100 and then manufacturing specific head sections 200 that comply with specific customers' orders. Additionally, a unique aspect of the invention is that it allows the utilization of multiple interchangeable heads that allows the owner to select the head and facial features that most remind them of the pet.

The head section 200 can be constructed from materials consisting of wood, plastic, rubber, resin, glass, metal, stone, concrete, and ceramics.

The third feature is the locking ring section 300 of the invention which is used to attach the head section 200 to the body section 400. The locking ring 300 of the invention is an assembly that comprises of an upper ring 310 which is attached to the head portion of the invention 200 and lower ring 320 of the locking ring 300 is attached to the body 400 and is designed to lock the head section 200 to the body section 400. The locking ring section 300 can be constructed from materials consisting of wood, plastic, rubber, resin, glass, metal, and ceramics.

A seal 317 is designed to fit between the head 200 and upper ring 310 and the lower ring 320 and body 400. The lower locking ring 320 is either permanently or removably mounted to the body section 400 and the upper locking ring 310 is either permanently or removably mounted to the head section 200.

The head section 200 is attached to the body section 400 by first placing the seal 317 on body 400 so that it covers the lower ring 320. The seal 317 is designed to prevent the cremated animal remains 560 from escaping from the hollow cavity portion 302 if the housing 100 is upset and falls over.

The next step for securing the head section 200 to the body section 400 is to align the tabs 315 on locking ring 310 with the slots 325 on locking ring 320 and pressing down on the head section 200 so that the tab 315 and the slot 325 are fully engaged. Then the head section 200 is rotated about the axis of opening 301 of the body 400 so that the head 200 is aligned with the body 400 and is securely attached to the body section 400. It should be noted that the locking ring section 300 of the invention allows for simple assembly and disassembly of the housing 100 to provide access to the hollow cavity portion 302.

Figure 8:
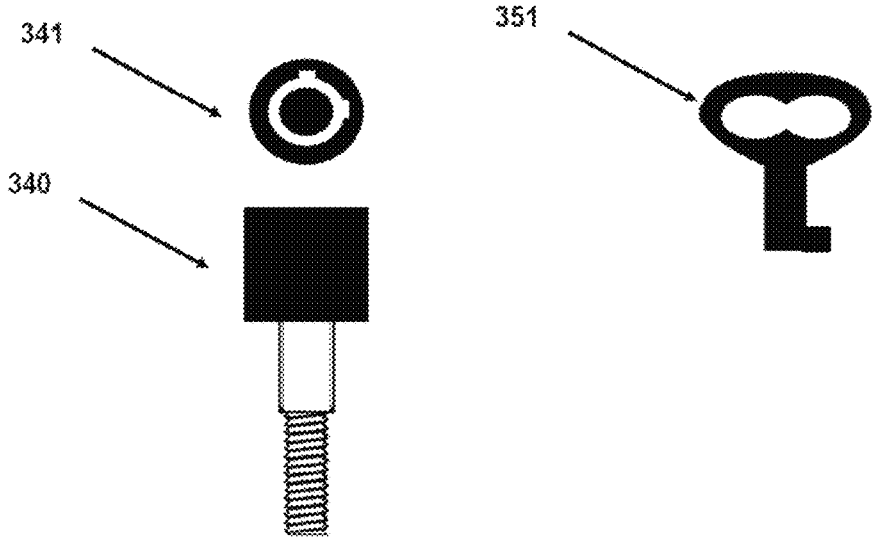
FIG. 8 is a view of the locking pin and corresponding key of the invention.
Figure 9:
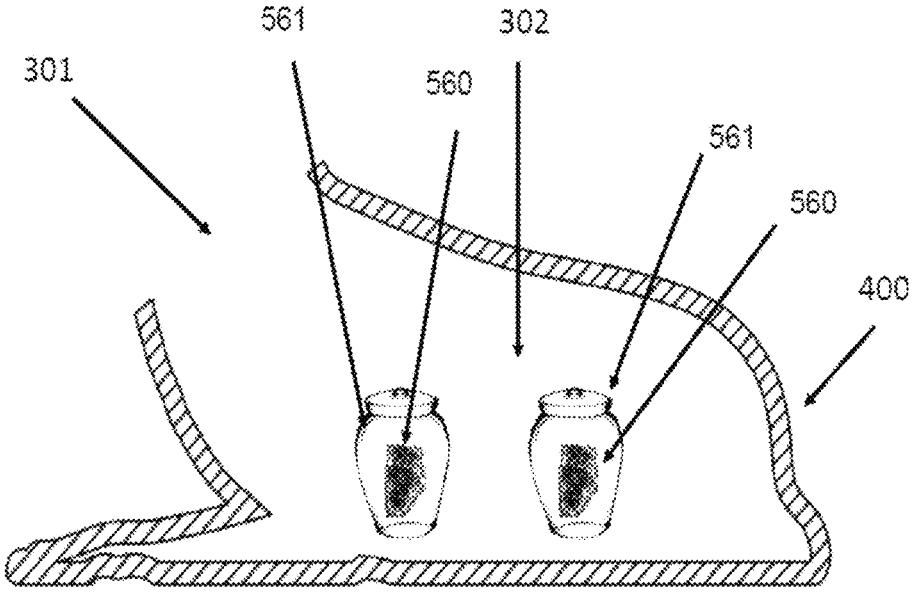
FIG. 9 is a cross sectional drawing of the lower portion of the invention holding stored remains in an urn.
Figure 11:
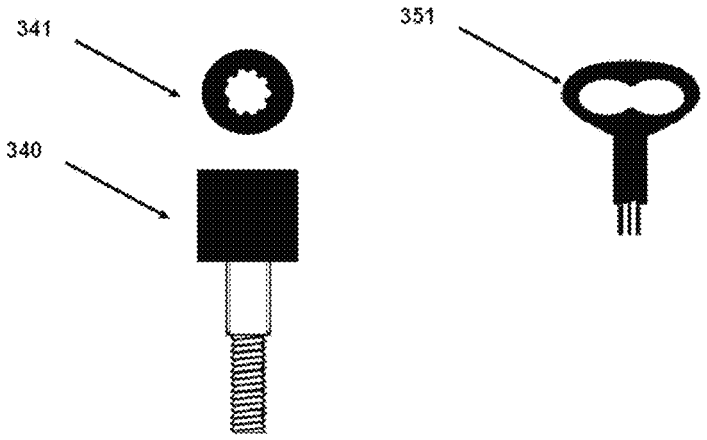
FIG. 11 is a view of the locking pin and corresponding key of the invention.
Figure 12:
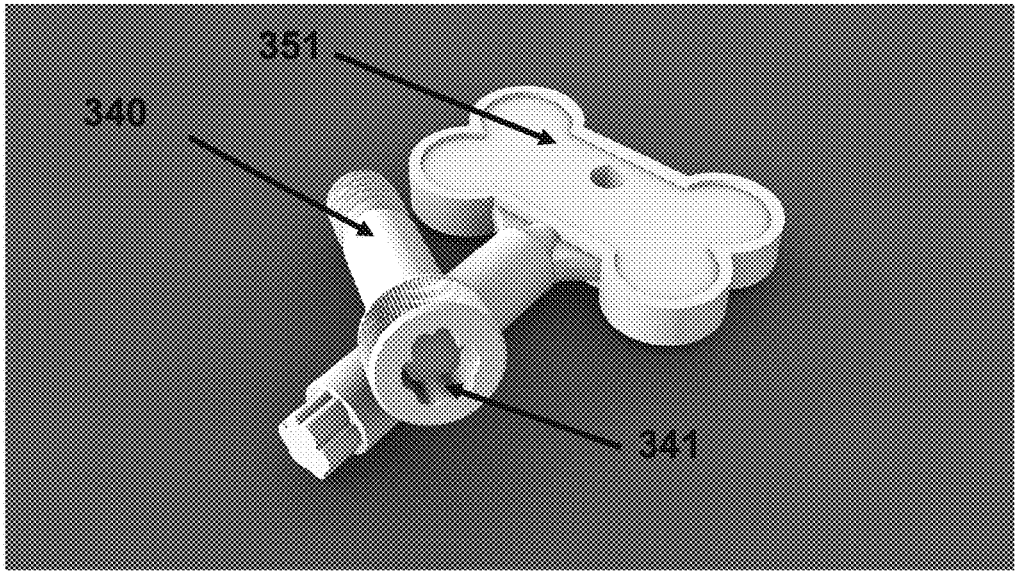
FIG. 12 is an alternative locking pin and corresponding key of the invention.

The owner can then lock the two sections together with the locking pin/screw 340 which is the fourth section of the invention as shown in FIGS. 8, FIG. 11 and 12. To achieve this, the owner first attaches the head 200 to the body 400 as described earlier and then they insert the locking pin/screw 340 into hole 350 in lower ring 320 which engages with hole 352 in upper locking ring 310 and then using key 351 to engage the lock by inserting the key 351 into key hole 341 to lock the locking pin/screw 340 to prevent removal of the head 200 from the body 400. Preferably a typical locking pin/screw 340 used with the invention is a threaded pin. However, one such example is a Baton Lock Products 7085⅝ cam lock. FIG. 11 illustrates a custom key and locking fastener. The key 351 fits into locking hole 341 in the locking pin/screw 340 and allows the locking pin/screw 340 to be turned by the key 351 to secure the head 200 and the body 400. It should be noted that the locking pin/screw 340 of the invention provides a simple removable means for securing the head 200 to the body 400 and allows for the assembly and disassembly of the housing 100 to provide access to the hollow cavity portion 302.

Other embodiments for the locking pin/screw 340 can include a cap screw, plunger, cap and spring clip, cam lever closure, or padlock.

The fifth section of the invention is the inner body hollow cavity portion 302 of the body 400 designed specifically for receiving the cremated animal remains 560 of an animal without an urn. The hollow cavity portion 302 is designed to allow a pet owner to place multiple cremated animal remains 560 in the same housing 100. To ensure that the body section 400 is non-porous an optional polymer coating can be applied to the interior of the hollow cavity 302 if the material used to make the body 400 is porous.

Figure 10:
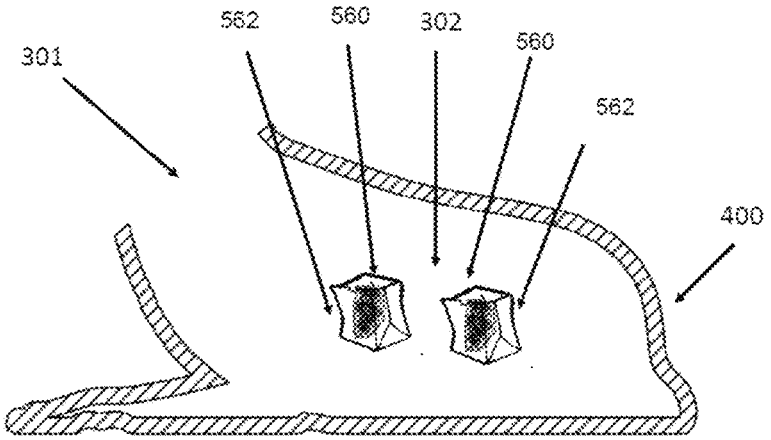
FIG. 10 is a cross sectional drawing of the lower portion of the invention holding stored remains in bags.

The cremated animal remains 560 are placed in the body 400 of housing 100 through opening 301 such that they reside in hollow cavity 302 and then the seal 317 and the head 200 is placed and locked into place with locking pin/screw 340 so that the cremated animal remains 560 are prevented from being removed from the housing 100. The unique design of the housing 100 allows the owner the ability to place multiple cremated animal remains 560 into the hollow cavity 302. Hollow cavity 302 can alternatively be constructed to hold a container which can be either a box, urn, or bag. FIGS. 8 and 10 show an urn and a bag but any suitable container that is acceptable to hold the remains 560 can be used. As shown in FIGS. 8 and 10 an urn 561 or bag 562 containing the cremated animal remains 560 can be stored in the hollow cavity 302.

The hollow cavity 302 can alternatively be designed to hold more than one urn 561 or bag 562 such that each urn 561 or bag 562 contains a different individual cremated animal remains 560 within an urn 561 or bag 562. This allows housing 100 to receive and hold separately multiple animal remains so they can be securely stored in the same housing 100.

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture.

Hence, while various embodiments are described with or without certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A cremated remains container for storing cremated remains of a pet, said cremated remains container comprising:

a) a body section, b) a head section, c) said body section being adapted to receive at least one head section, d) an opening in said body section wherein said opening is in communication with a cavity in said body section, e) said cavity disposed in said body section, and configured for receiving therein said cremated remains of a pet, f) said cavity in said body being made from a non-porous material, g) an upper locking ring in communication with said head section, h) a lower locking ring in communication with said body section, i) a locking pin operably locking said upper locking ring to said lower locking ring, j) said locking pin preventing the head section from being removed from said body section, k) a sealing means in communication with said upper locking ring to said lower locking ring.

2. The cremated remains container of claim 1, wherein the pin is associated with a key and said key is capable of engaging a lock to prevent the pin from being removed from said head section or said body section.

3. The cremated remains container as in claim 1, wherein said cavity is configured hold more than one said cremated remains of a pet.

4. The cremated remains container as in claim 1, wherein said head section is representative of a specific pet.

5. The cremated remains container as in claim 1, wherein said lower and upper locking rings are locked with said locking pin.

6. The cremated remains container as in claim 1, wherein said body section is made from material selected from the group consisting of wood, plastic, rubber, resin, glass, metal stone, concrete, and ceramic.

7. The cremated remains container as in claim 1, wherein said head section is made from material selected from the group consisting of wood, plastic, rubber, resin, glass, metal, stone, concrete, and ceramic.

8. The cremated remains container as in claim 1, wherein said seal fits between said head section and said body section and is in communication with said upper locking ring and said lower locking ring.

9. A cremated remains container for storing cremated remains of a pet, said cremated remains container comprising:

a) a body section, b) a head section, c) said body section being adapted to receive at least one head section, d) an opening in said body section wherein said opening is in communication with a cavity, e) said cavity disposed in said body section, and configured for receiving therein at least one inner container containing said cremated remains of a pet, f) an upper locking ring in communication with said head section, g) a lower locking ring in communication with said body section, h) a locking pin operably locking said upper locking ring to said lower locking ring, i) said locking pin preventing the head section from being removed from said body section.

10. The cremated remains container of claim 9, wherein the pin is associated with a key and said key is capable of engaging a lock to prevent the pin from being removed from said head section or said body section.

11. The cremated remains container as in claim 9, wherein said cavity is configured hold more than one said inner container containing said cremated animal remains.

12. The cremated remains container as in claim 9, wherein said head section is representative of a pet.

13. The cremated remains container as in claim 9, wherein said lower and upper locking rings are locked with said locking pin.

14. The cremated remains container as in claim 9, wherein said body section is made from material selected from the group consisting of wood, plastic, rubber, resin, glass, metal, stone, concrete, and ceramic.

15. The cremated remains container as in claim 9, wherein said head section is made from material selected from the group consisting of wood, plastic, rubber, resin, glass, metal, stone, concrete, and ceramic.

16. The cremated remains container as in claim 9, wherein the said inner container is selected from the group consisting of an urn, a bag and a box.

* * * * *